US012655353B2

(12) United States Patent
Saffrin et al.

(10) Patent No.: US 12,655,353 B2
(45) Date of Patent: Jun. 16, 2026

(54) CROSS OVER DUCT FOR HEATING WALLS OF A COKE OVEN OR COKE OVEN BATTERY

(71) Applicant: VANOCUR REFRACTORIES LLC, Tonawanda, NY (US)

(72) Inventors: Paul A. Saffrin, Tonawanda, NY (US); Richard M. Maida, Tonawanda, NY (US)

(73) Assignee: VANOCUR REFRACTORIES, LLC., Tonawanda, NY (US)

( * ) Notice: Subject to any disclaimer, the term of this patent is extended or adjusted under 35 U.S.C. 154(b) by 173 days.

(21) Appl. No.: 18/701,472

(22) PCT Filed: Oct. 14, 2022

(86) PCT No.: PCT/US2022/078138

§ 371 (c)(1),
(2) Date: Apr. 15, 2024

(87) PCT Pub. No.: WO2023/064916

PCT Pub. Date: Apr. 20, 2023

(65) Prior Publication Data

US 2024/0400902 A1 Dec. 5, 2024

Related U.S. Application Data

(60) Provisional application No. 63/262,568, filed on Oct. 15, 2021.

(51) Int. Cl.

| | |
|---|---|
| ***C10B 5/04*** | (2006.01) |
| ***C10B 5/12*** | (2006.01) |
| ***C10B 29/02*** | (2006.01) |

(52) U.S. Cl.
CPC ..... *C10B 5/04* (2013.01); *C10B 5/12* (2013.01); *C10B 29/02* (2013.01)

(58) Field of Classification Search
CPC ..... C10B 29/00; C10B 29/02; C10B 29/06
See application file for complete search history.

(56) References Cited

U.S. PATENT DOCUMENTS

| | | | | |
|---|---|---|---|---|
| 1,374,546 A | | 4/1921 | Becker | |
| 1,678,802 A | * | 7/1928 | Becker | C10B 5/02 202/141 |
| 1,706,476 A | | 3/1929 | Becker | |
| 1,754,131 A | | 4/1930 | Van Ackeren | |
| 1,832,612 A | * | 11/1931 | Becker | C10B 5/02 202/143 |
| 1,872,532 A | | 8/1932 | Van Ackeren | |
| 2,294,005 A | | 8/1942 | Alan et al. | |

(Continued)

FOREIGN PATENT DOCUMENTS

| | | |
|---|---|---|
| DE | 4103737 A1 | 8/1991 |
| EP | 0527318 A2 | 2/1993 |

(Continued)

*Primary Examiner* — Jonathan Luke Pilcher
(74) *Attorney, Agent, or Firm* — Simpson & Simpson, PLLC

(57) ABSTRACT

In a coke oven having a first heating wall and a second heating wall, a cross over duct arranged to fluidly connect the first heating wall and the second heating wall. The cross over duct further comprising a passageway in communication with the first heating wall and the second heating wall.

12 Claims, 7 Drawing Sheets

(56) References Cited

U.S. PATENT DOCUMENTS

| | | | | | |
|---|---|---|---|---|---|
| 2,839,454 | A | * | 6/1958 | Van Ackeren | C10B 5/02 202/268 |
| 2,863,807 | A | | 12/1958 | Van Ackeren | |
| 3,102,846 | A | * | 9/1963 | Tucker, Jr. | C10B 29/02 202/139 |
| 3,839,158 | A | | 10/1974 | Helm | |
| 4,431,484 | A | * | 2/1984 | Weber | C10B 5/02 202/141 |
| 5,423,152 | A | | 6/1995 | Kolvek | |
| 2008/0169578 | A1 | | 7/2008 | Crane et al. | |
| 2018/0362854 | A1 | | 12/2018 | Bowser, Jr. et al. | |

FOREIGN PATENT DOCUMENTS

| | | | |
|---|---|---|---|
| GB | 155316 | A | 12/1920 |
| GB | 432345 | A | 7/1935 |
| GB | 666279 | A | 2/1952 |
| JP | 2016222758 | A | 12/2016 |
| JP | 2017137447 | A | 8/2017 |

* cited by examiner

CROSS OVER DUCT FOR HEATING WALLS OF A COKE OVEN OR COKE OVEN BATTERY

CROSS-REFERENCE TO RELATED APPLICATIONS

This application claims the benefit under Articles 4 and 8 of the Stockholm Act of the Paris Convention for the Protection of Industrial Property of U.S. Provisional Patent Application No. 63/262,568, filed on Oct. 15, 2021, which application is hereby incorporated by reference herein in its entirety.

FIELD

The present invention relates to coke ovens, and more particularly, to a cross over duct that connects flues of different heating walls to regulate the temperature and exhaust gases therein.

BACKGROUND

Coke is typically produced by heating coal in a coke oven battery. This battery may have anywhere from 40 to over 100 side-by-side coking chambers or ovens separated from each other by heating walls. Gas is burned within the walls to heat the coal arranged in the ovens. The floor bricks of each oven rest upon corbels. Below the corbels is an area called the regenerator. The regenerator is filled with bricks that have a relatively large amount of surface area per volume, generally due to slots formed in the bricks. In the regenerator, exhaust waste heat is used to pre-heat incoming air as well as cool the exhaust waste heat prior to discharge. The slotted bricks are called checker bricks, and they facilitate the heat transfer from the exhaust waste heat to the combustion materials. The regenerator supports the corbels. In turn, the corbels support the coke oven floor bricks and the heating walls. The heating walls, floor bricks, and corbels have traditionally been made of silica brick.

Coal is crushed and blended prior to being charged in a coke oven. A larry car charges the individual oven with the blended coal. In the coke oven, the coal is heated to 1,800° F. for up to 18 hours-thus the importance of the regenerator to conserve heat. During that time, the volatiles of the coal are driven into the offgas (removed), and a pure carbon form called "coke" remains.

However, current coke oven battery designs only circulate and/or vent exhaust gases within the specific flue of the heating wall. Specifically, exhaust gases are forced out of the flue, down through the corbel, and into the regenerator. Such designs do not allow for optimal air flow within the heating wall, specifically the flue, and lead to undesirable heating characteristics (i.e., loss of heat, increased fluid pressure within the flue, etc.).

Thus, there is a long felt need for a cross over duct that connects the flues of two different heating walls of a coke oven and improves air and gas flow therein.

There is another long felt need for a cross over duct that connects the flues of two different heating walls of a coke oven thereby decreasing and/or eliminating: excessive loss of heat therein; excessive fluid, and/or gas, pressure therein; and potential leak points created at seams between components of the flues-preserving the structural integrity of the flues over a longer period of time and saving potential repair costs.

There is a further long felt need for a cross over duct that connects the flues of two different heating walls of a coke oven, improves air and gas flow therein, provides for an oven ceiling of a coke oven therebelow, and at least partially provides for a portion of a coke oven battery top.

SUMMARY

The present invention is generally arranged in a coke oven having a first heating wall and a second heating wall, where the present invention generally comprises a cross over duct arranged to fluidly connect the first heating wall and the second heating wall of the coke oven. The cross over duct may further comprise a passageway in communication with the first heating wall and the second heating wall.

In some embodiments, the present invention may generally comprise a coke oven battery, the coke oven battery including an oven floor, a first heating wall including a first flue, a second heating wall including a second flue, the second heating wall spaced apart from the first heating wall forming a coke oven therebetween, and a cross over duct, the cross over duct comprising a passageway having a passageway disposed therein, a first aperture open to the passageway, and a second aperture open to the passageway, where the first aperture is in communication with the first flue and the second aperture is in communication with the second flue. The cross over duct may further comprise a first section having a channel disposed therein, the first aperture disposed within the first section, the first aperture open to the channel and a third aperture open to the channel, and a second section having a channel disposed therein, the second aperture disposed within the second section, the second aperture open to the channel of the second section and a fourth aperture open to the channel of the second section, wherein the first channel of the first section and the second channel of the second section form the passageway.

In other embodiments, the present invention may be generally arranged in a coke oven having a first heating wall and a second heating wall, where the present invention may generally comprise a cross over duct arranged to fluidly connect the first heating wall and the second heating wall, the cross over duct comprising a first section having an external surface and an internal surface, the first section having a channel disposed therein, the channel terminated by a first aperture disposed on the internal surface and a second aperture disposed on the internal surface, and a second section having an external surface and an internal surface, the second section having a channel disposed therein, the channel terminated by a first aperture disposed on the internal surface and a second aperture disposed on the internal surface, where the channel of the first section and the channel of the second section form a passageway, the passageway in fluid communication with the first heating wall and the second heating wall.

These and other objects, features, and advantages of the present invention will become readily apparent upon a review of the following detailed description of the invention, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
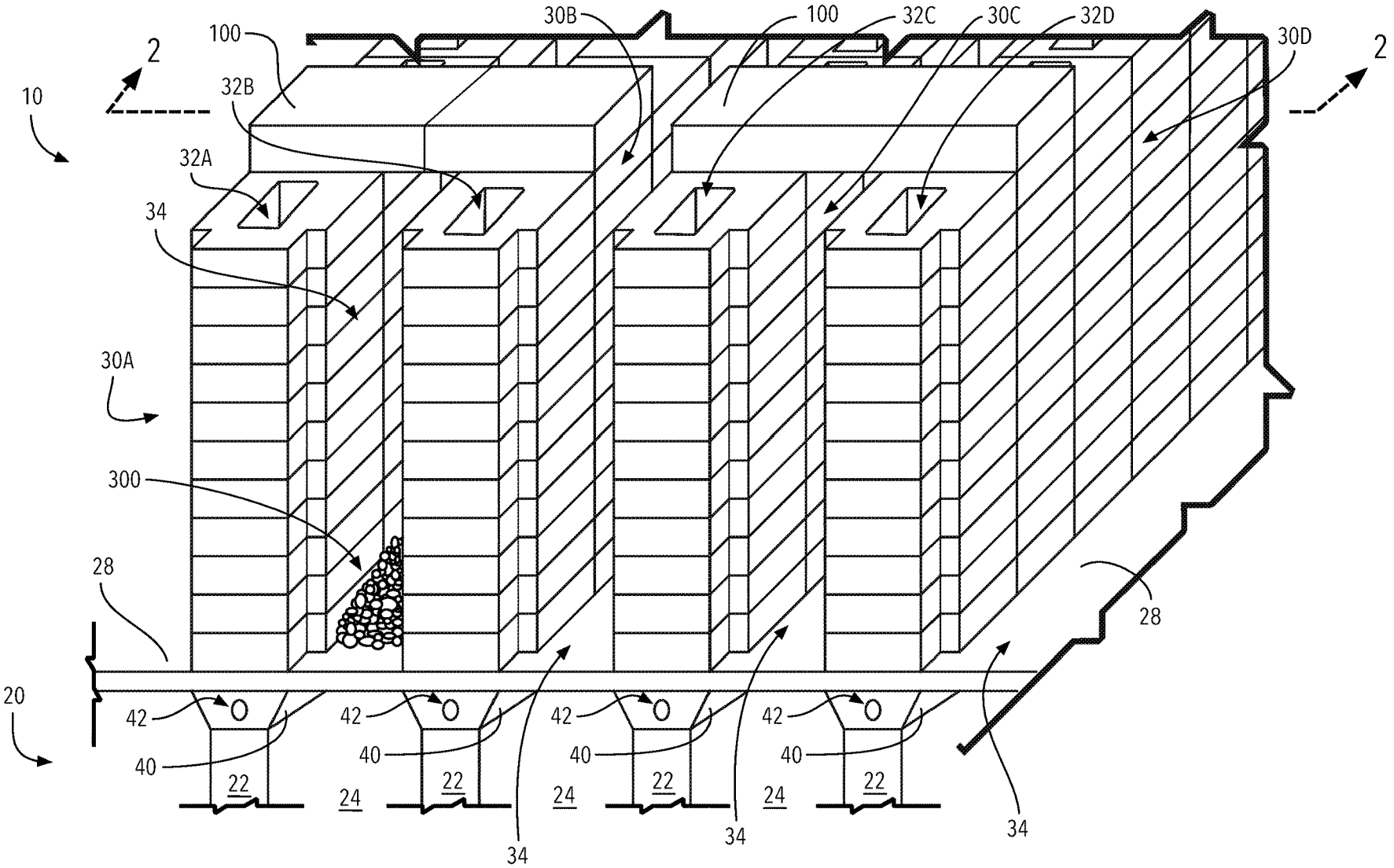
FIG. 1 is a partial perspective view of a coke oven battery, in accordance with some embodiments of the present invention.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this invention pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein.

As used herein, "vent" is meant to mean an opening that allows fluid to pass out of or into a confined space, such as a duct. The term "fluid" includes gas.

As also used herein, "fluid communication", "communication", and/or substantial equivalents thereof, is meant to mean two or more components are connected such that a substance, e.g., gases, fluid, etc., can flow between and/or within the two components. "Fluid communication", "communication", and/or equivalents thereof, is also intend to include heat transfer between two or more components.

Coke Oven Battery

Figure 2:
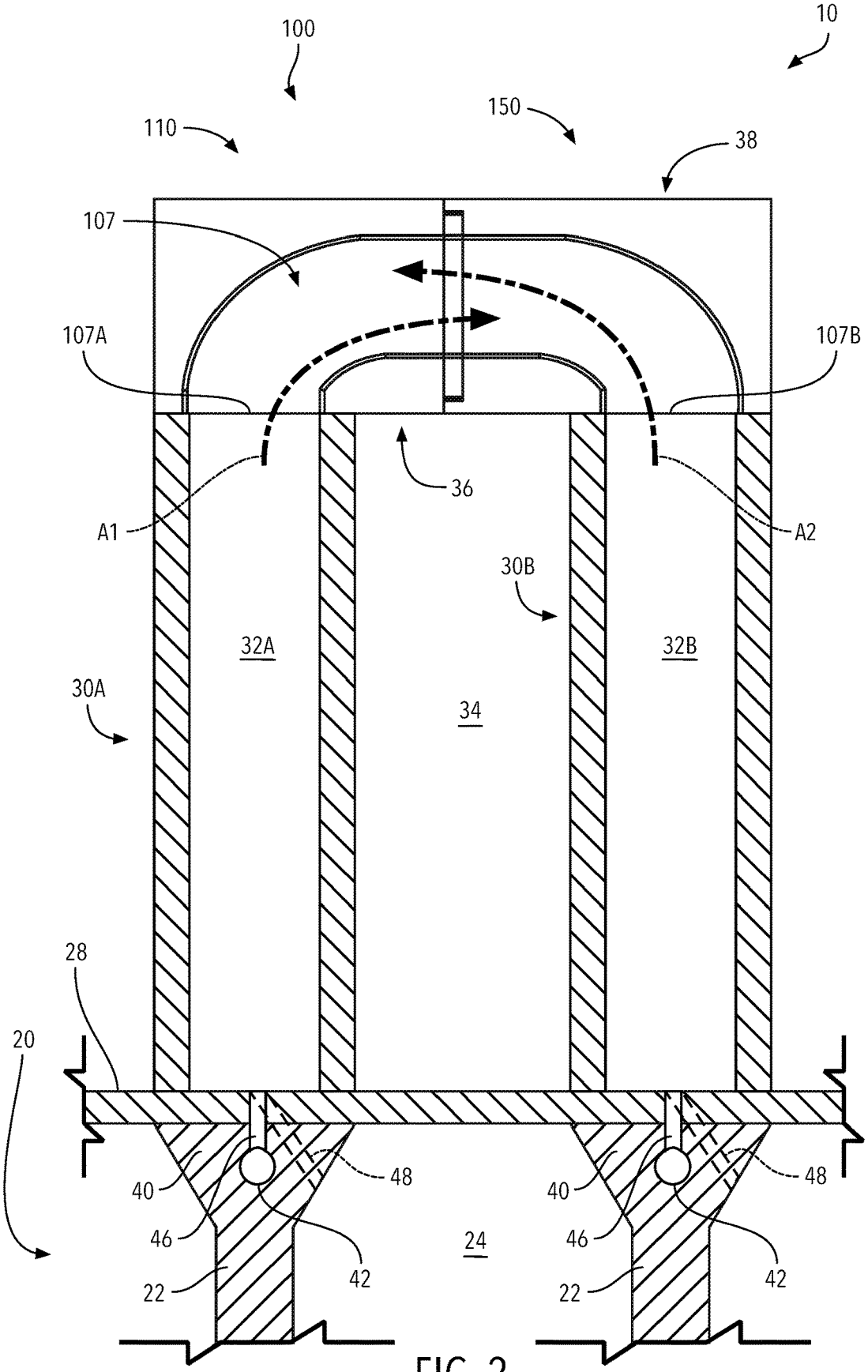
FIG. 2 is a partial cross-sectional view of the coke oven battery taken generally along line 2-2 in FIG. 1.

Referring now to the figures, the following description should be taken in consideration of FIGS. 1 and 2. FIG. 1 is a partial perspective view of coke oven battery 10, in accordance with some embodiments of the present invention. FIG. 2 is a partial cross-sectional view of coke oven battery 10 taken generally along line 2-2 in FIG. 1. Coke oven battery 10 generally comprises regenerator 20 and one or more ovens 34.

Regenerator 20 comprises a plurality of piers or pillars 22, which are spaced apart to form regenerator regions 24. In some embodiments, each of pillars 22 comprises a plurality of bricks or blocks. Pillars 20 support corbels 40. In some embodiments, each of corbels 40 comprises a plurality of blocks. In some embodiments, corbels 40 comprise a plurality of blocks arranged in a plurality of tiers.

Corbels 40 are arranged on top of pillars 20 and support the oven section of coke oven battery 10. Specifically, corbels 40 support floor 28, heating walls 30A-D, and coal placed in ovens 34, allow air to flow between flues 32A-D and regenerator 20, and/or allow gas to be injected into flues 32A-D. For example, gas or fuel is injected into corbels 40 horizontally via through-bore 42 and flows vertically through holes 46 and into flues 32A-D. Air flows up through holes 48 and into flues 32A-D where it mixes with the fuel and combusts to heat heating walls 30A-D, respectively, thus cooking coal 300 arranged in ovens 34 transforming it into coke (Coal 300 shown in the drawing is merely representative. In practice, the coal is crushed and blended prior to being charged in the coke oven.) Exhaust gasses are created from such combustion, these hot exhaust gases may flow down through holes 48 and into regenerator regions 24, thereby preheating the incoming gas and/or air. Preheating gas and/or air as it flows into flues prior to combustion is desirable because it produces more efficient vaporization and higher combustion efficiency than cold fuel. In some embodiments, coke oven battery 10 further comprises shut-off means (not illustrated) operatively arranged to selectively shut off the gas flow through one or more holes 42. The shut-off means (e.g., valves) allow the operator to control the temperature in each flue 32A-D and thus ovens 34. In some embodiments, and as shown, coke oven battery 10 further comprises one or more cross over ducts 100 operatively arranged to facilitate the transfer of gases between the flues of the heating walls, as will be described in greater detail, infra.

Floor 28 is arranged on and/or engaged with corbels 40. Floor 28 is operatively arranged to support coal 300 in ovens 34. In some embodiments, floor 28 comprises a plurality of blocks. In some embodiments, floor 28 comprises a plurality of blocks arranged in a plurality of tiers. Heating walls 30A-D are arranged on corbels 40 and/or floor 28 and comprise flues 32A-D arranged therein, respectively. (Heating walls 30A-D are comprised of bricks, blocks and/or modules.) Flues 32A-D are in fluid communication with holes 46 and holes 48. Oven ceiling or ceilings 36 are arranged proximate the, or on, top of heating walls 30A-D. Thus, ovens 34 are formed by floor 28, heating walls 30A-D, and oven ceiling 36. Battery top 38, or ceiling, is typically arranged on top of heating walls 30 (typically a separate component of coke oven battery, but integral with cross over duct 100, as shown in FIG. 2) and may enclose flues 32A-D. In some configurations of the present invention, cross over ducts 100 form both oven ceiling 36 and battery top 38 (as shown in FIG. 2), a significant improvement over traditional configurations of coke oven construction, as will be described in greater detail below. In some embodiments, each flue 32A-D is in fluid communication with at least one hole 46 and at least one hole 48, which thereby provides gas (via hole 46) and air (via hole 48) to that flue. The arrangement of having at least one gas injection hole 46 and an air injection hole 48 into a single flue provides a desirable combustion mixture of air and fuel.

Generally, cross over duct 100 (and cross over duct 200) provide for a transfer of gases, heat, fuel, etc., between two heating walls of coke oven battery 10—generally depicted as arrows A1 and A2, illustrating the aforementioned transfer between heating walls 30A and 30B, specifically flues 32A and 32B, i.e., cross over duct 100 fluidly connects two heating walls. It should be noted that these heating walls are typically isolated, i.e., not in fluid communication.

Cross Over Duct

Figure 3A:
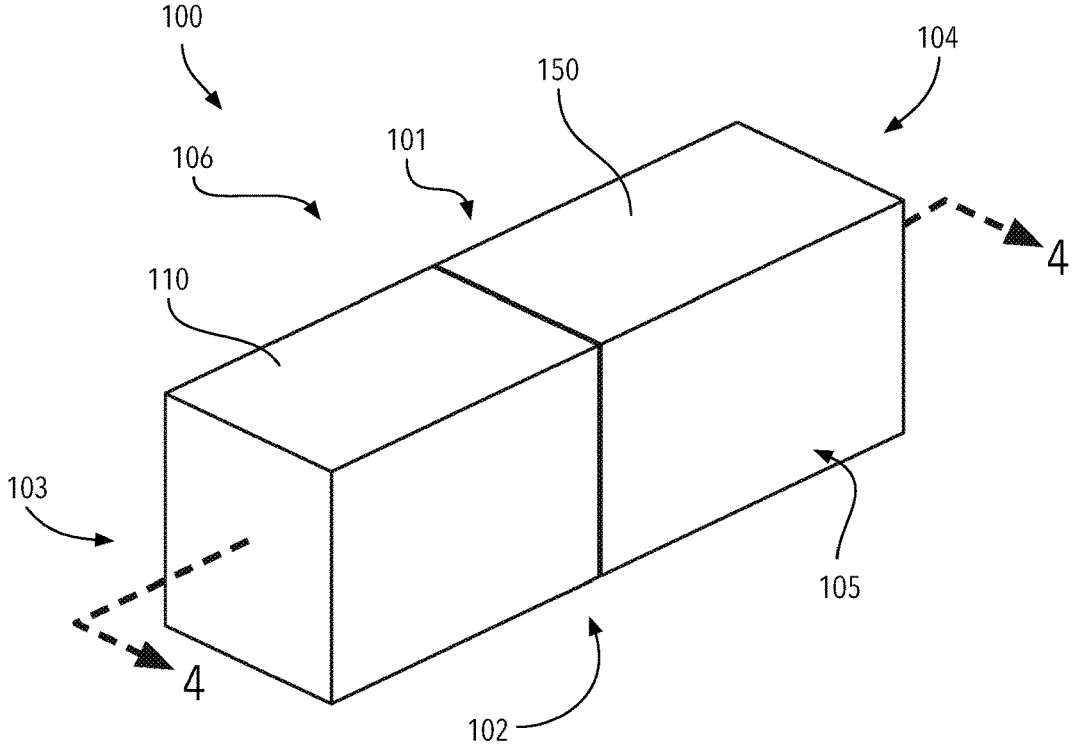
FIG. 3A generally illustrates a perspective view of the cross over duct shown in FIGS. 1 and 2.
Figure 3B:
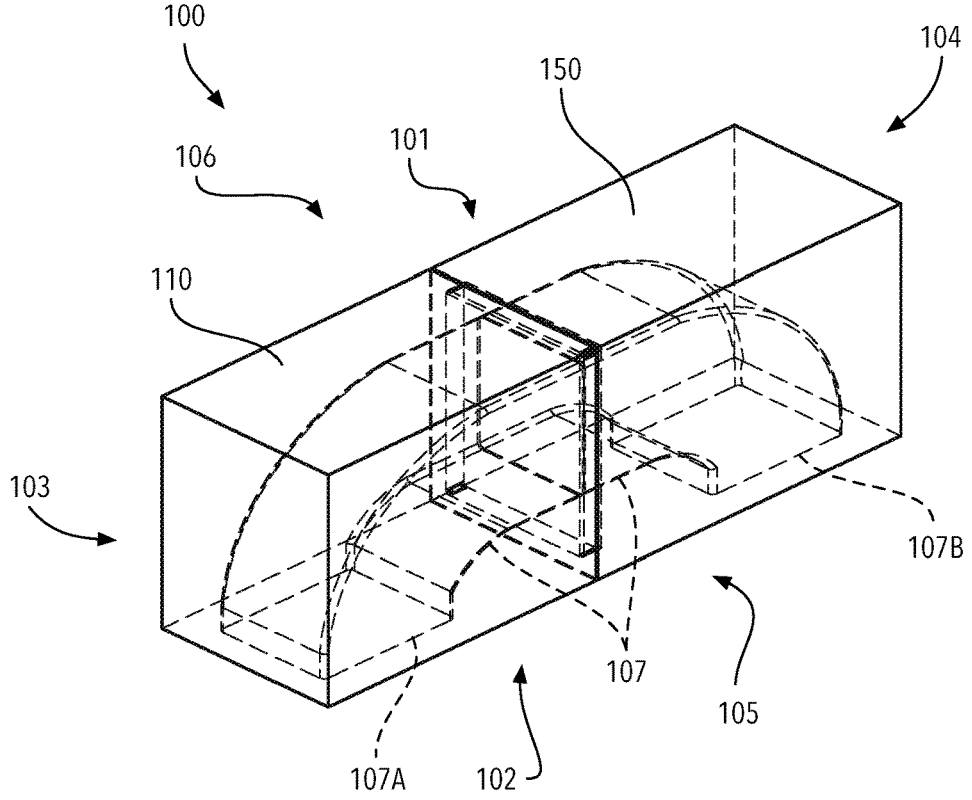
FIG. 3B generally illustrates a skeleton perspective view of the cross over duct shown in FIG. 3A.
Figure 4:
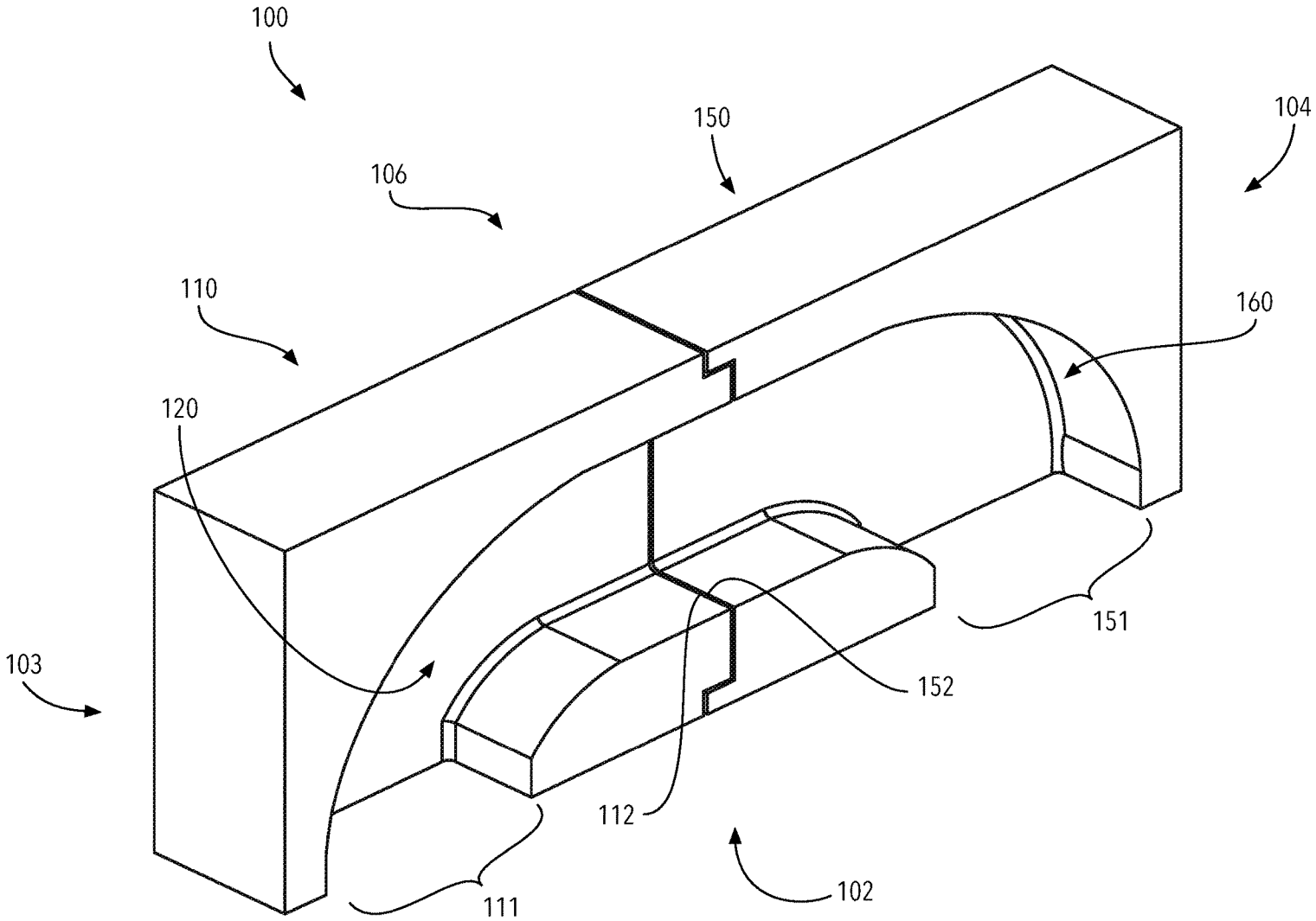
FIG. 4 is a cross-sectional view of the cross over duct taken generally along line 4-4 in FIG. 3A.

The following description should be taken in view of FIGS. 3A through 4, generally illustrating a perspective view of cross over duct 100, a skeleton perspective view of the same, and a cross-sectional view taken generally along line 4-4 in FIG. 3A. Cross over duct 100 generally includes proximal end 101, distal end 102, first end 103, second end 104, first side 105, and second side 106. Cross over duct 100 includes section 110 and section 150, shown joined, or connected, in FIG. 1. Cross over duct 100 also includes passageway 107 therein. Passageway 107 has two apertures 107A and 107B, preferably disposed on distal end 102.

Cross over duct 100 may comprise two sections, 110 and 150, which collectively form cross over duct 100. Section 110 has channel 120 therein, terminated by apertures 111 and 112. Section 150 has channel 160 therein, terminated by apertures 151 and 152. When section 110 is connected to section 150, aperture 112 of section 110 joins aperture 152 of section 150 to form a fluid connection between channel 120 and channel 160. When channel 120 and channel 160 are in fluid connection, passageway 107 is formed.

Section 110 and section 150 may be connected via any suitable means, for example, adhesives, mortar, interference or press fit, bolts, rods, etc., to form duct 100.

Although duct 100 is generally illustrated as having sections 110 and 150, collectively forming duct 100, it should be appreciated that duct 100 may be alternatively configured as a singular piece.

It should be appreciated that distal end 102 of cross over duct 100 also provides for oven ceiling 36 of oven 34 (as shown in FIG. 2). It should also be appreciated that proximal end 101 also provides for at least a section or portion of battery top 38 of coke oven battery 10 (as shown in FIG. 2). As such, cross over duct 100 at least partially provides for battery top 38 and/or oven ceiling 36—eliminating the need for additional bricks, blocks, and/or modules, during construction or repair of coke oven battery 10.

In some configurations of cross over duct 100, proximal surface 101 may include at least one aperture disposed therein, where that aperture is in fluid communication with passageway 107—providing for an inspection access to passageway 107 from proximal surface 101 (or battery top 38). In other configurations, cross over duct 100 may include at least aperture disposed within proximal surface 101 and within section 110, where that aperture is in fluid communication with channel 120—providing for an inspection access to channel 120 from proximal surface 101 (or battery top 38) within section 110 of duct 100. In further configurations, cross over duct 100 may include at least aperture disposed within proximal surface 101 and within section 150, where that aperture is in fluid communication with channel 160—providing for an inspection access to channel 160 from proximal surface 101 (or battery top 38) within section 150 of duct 100. This inspection access, or aperture, could be configured with a seal, shelf to removably accept an inspection plate, or the like, to close off the access to passageway 107, channel 110, and/or channel 150.

Figure 5A:
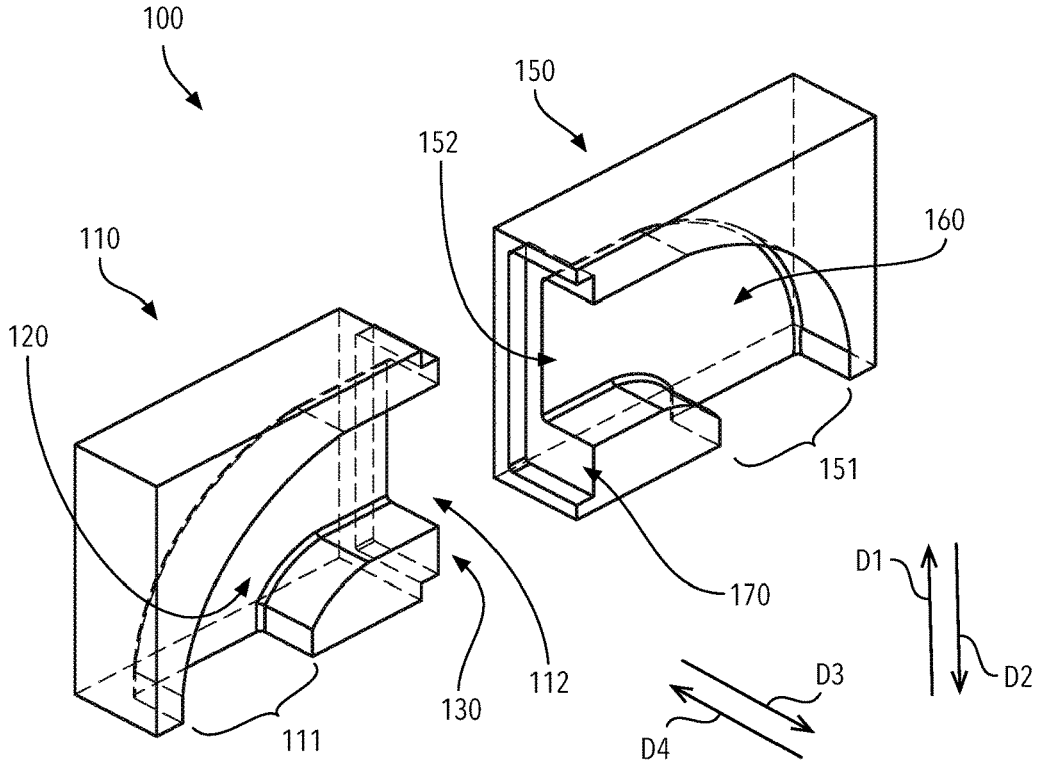
FIG. 5A is an exploded perspective cross-sectional view of the invention shown in FIG. 4.
Figure 5B:
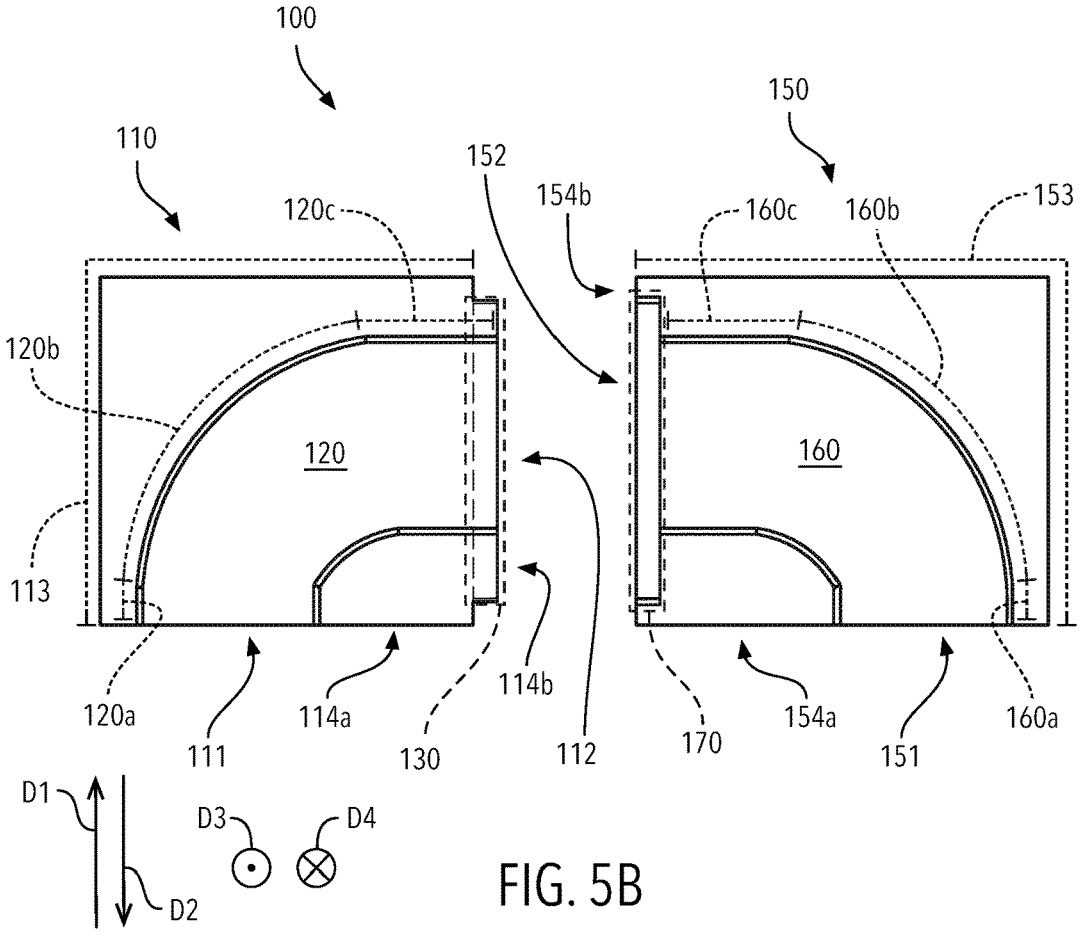
FIG. 5B is an exploded side cross-sectional view of the invention shown in FIG. 4.

The following description should be taken in consideration of the aforementioned figures, FIG. 5A and FIG. 5B. FIG. 5A illustrates an exploded cross-sectional view of duct 100 taken generally along line 4-4 in FIG. 1 and FIG. 5B illustrates an exploded side view of the same. Section 110 of duct 100 includes external surface 113 and internal surfaces 114*a* and 114*b*. Section 150 of duct 100 includes external surface 153 and internal surfaces 154*a* and 154*b*. Aperture 111 of channel 120 is arranged within internal surface 114*a* and aperture 112 of channel 120 is arranged within internal surface 114*a*, preferably within protruding section 130. Aperture 151 of channel 160 is arranged within internal surface 154*a* and aperture 152 of channel 160 is arranged within internal surface 154*b*, preferably within recessed section 170.

Channel 120 of section 110 generally comprises three sections: distal section 120*a*, medial section 120*b*, and proximal section 120*c*. In some configurations, distal section 120*a* and proximal section 120*c* have a substantially linear configuration whereas medial section 120*b* has a substantially curvilinear configuration. Channel 160 of section 150 generally comprises three sections: distal section 160*a*, medial section 160*b*, and proximal section 160*c*. In some configurations, distal section 160*a* and proximal section 160*c* have a substantially linear configuration whereas medial section 160*b* has a substantially curvilinear configuration. This configuration of channels 120 and 150 (or passageway 107 when sections 110 and 150 are connected) is preferably to encourage efficient and proper flow of gases, heat, waste, particulate matter, or a combination thereof.

In order to create a more secure fit between section 110 and section 150, section 110 includes protruding section 130 and section 150 includes recessed section 170. When joined, combined, connection, protruding section 130 is arranged to be substantially seated, or at least partially within, recessed section 170 of section 150. This arrangement also decreases and/or eliminates excessive movement in directions D1 through D4. Additionally, this arrangement also prevents the creation of a straight joint, or seam, when sections 110 and 150 are connected—25 thereby decreasing the potential for leak points within the seam over an extended operational period.

Sections 110 and 150 may be connected via any suitable means, for example, adhesives, mortar, interference or press fit, bolts, rods, etc., to form cross over duct 100.

As best shown in FIG. 2, internal surfaces 114*a* and 154*a* of section 110 and 150, respectively, forms oven ceiling 36 and the top portion of cross over duct 100, for example, top surface 56, forms battery top 38. Thus, cross over duct 100 forms four purposes: it encloses oven 34 (by providing for oven ceiling 36 as shown in FIG. 2), it encloses flues 32A-D (flues 32C and 32D are shown in FIG. 1), it fluidly connects flues of different heating walls to allow the transfer of gas and temperature therebetween—generally illustrated by arrows A1 and A2, and it forms at least a portion of battery top 38 (as shown in FIG. 2).

Cross Over Duct: Alternative Embodiment

Figure 6A:
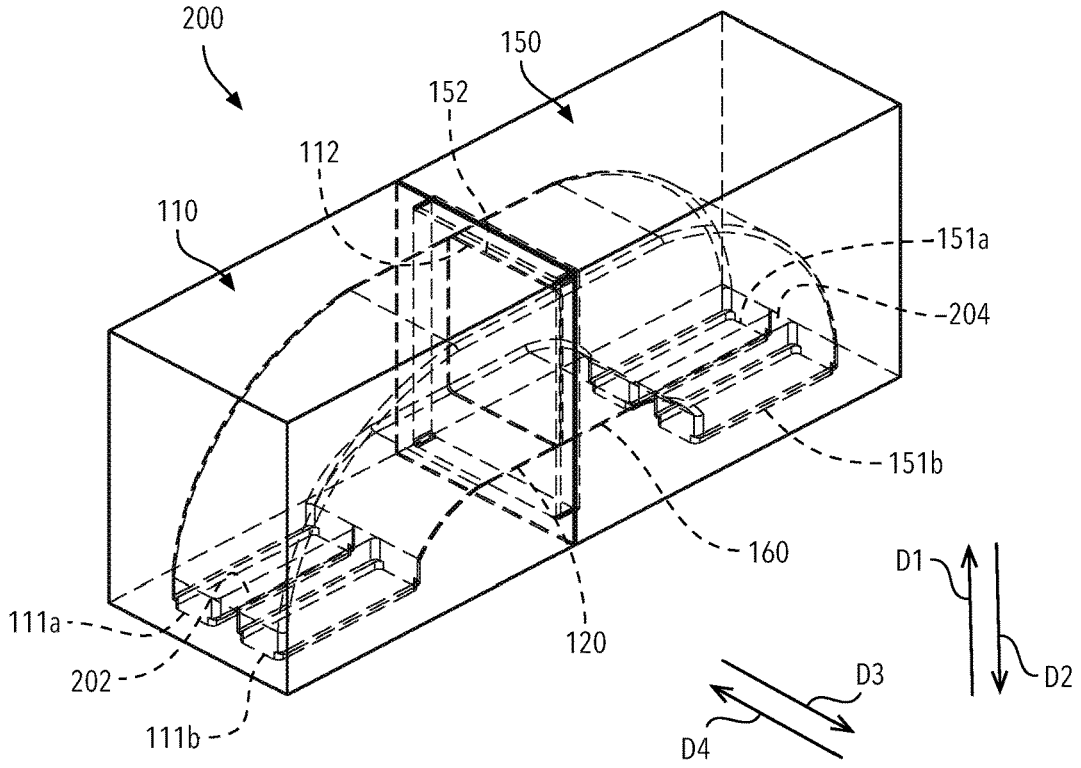
FIG. 6A generally illustrates a skeleton perspective view of an alternative embodiment of the present invention.
Figure 6B:
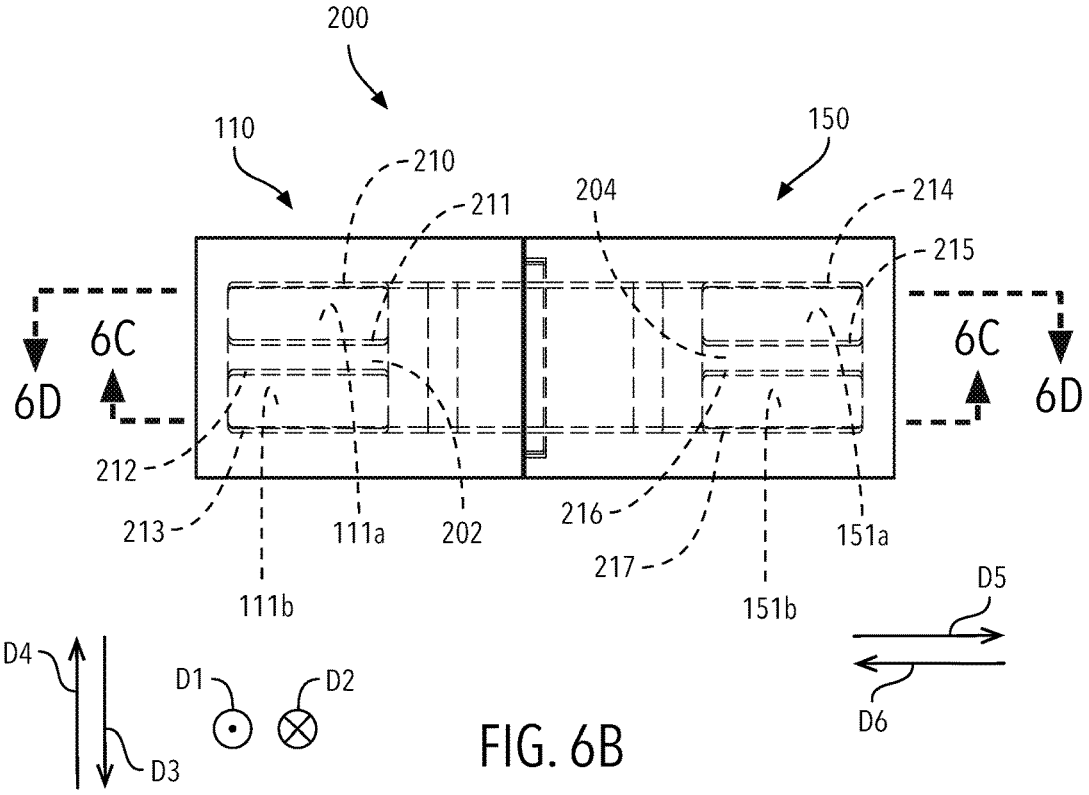
FIG. 6B generally illustrates a top skeleton view of the invention shown in FIG. 6A.
Figure 6C:
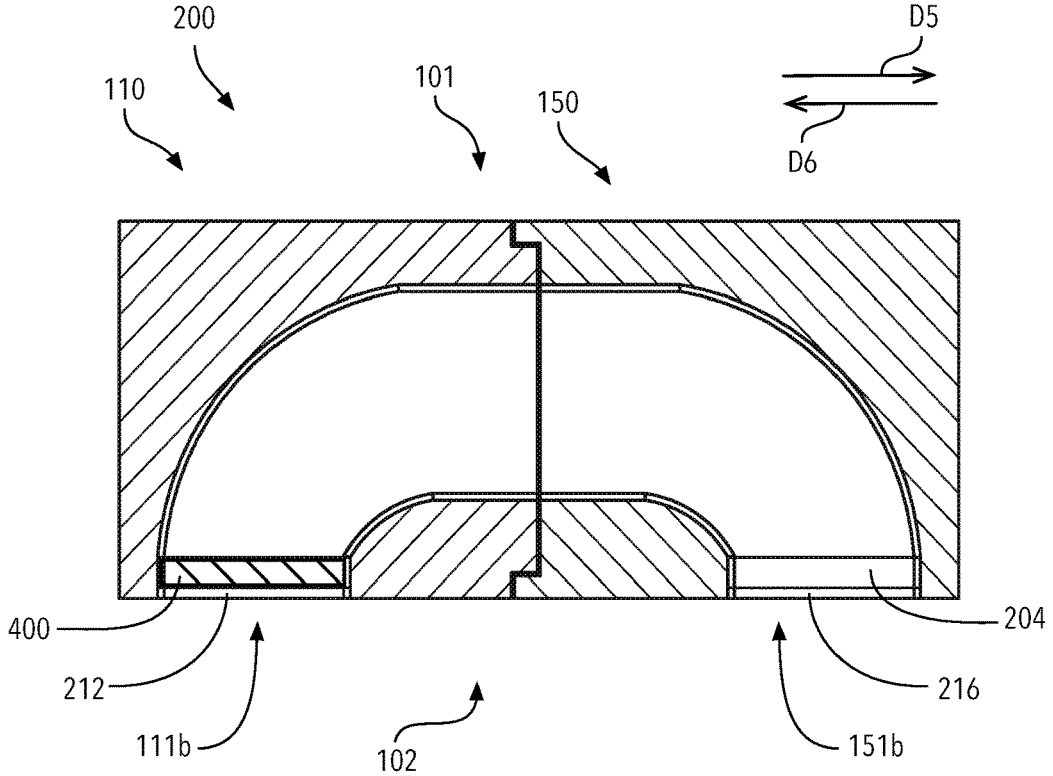
FIG. 6C is a cross-sectional view of the cross over duct taken generally along line 6C-6C in FIG. 6B; and, FIG. 6D is a cross-sectional view of the cross over duct taken generally along line 6D-6D in FIG. 6B.
Figure 6D:
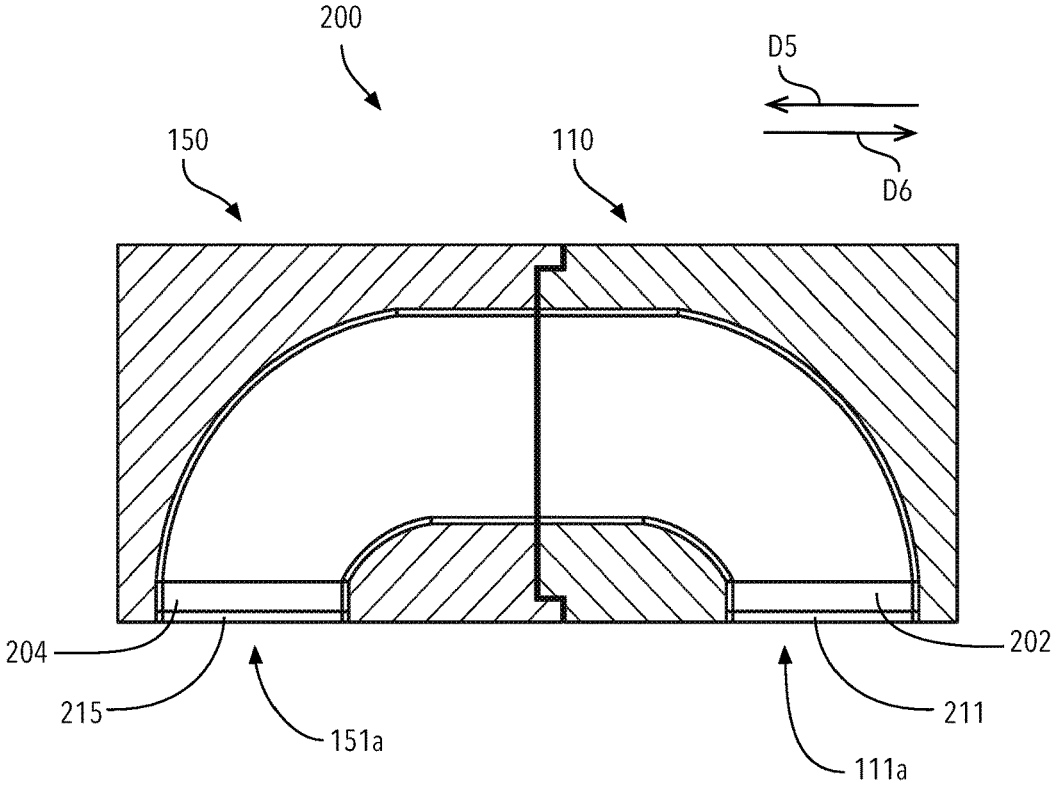

The following description should be taken in view of the aforementioned figures, FIG. 6A, FIG. 6B through 6D, where FIG. 6A generally illustrates a skeleton perspective view of an alternative embodiment of duct 100, duct 200, FIG. 6B generally illustrates a top skeleton view, FIG. 6C is a cross sectional view taken generally along line 6C-6C in FIG. 6B, and FIG. 6D is a cross sectional view taken generally along line 6D-6D in FIG. 6B.

Duct 200 includes all of the components of duct 100, with the exception of apertures 111 and 151 of sections 110 and 150, respectively. Section 110 of duct 200 includes apertures 111*a* and 111*b*, and section 150 of duct 200 includes apertures 151*a* and 151*b*. Aperture 111*a* and 111*b* are separated by bifurcating section 202 and apertures 151*a* and 151*b* are separated by bifurcating section 204. Aperture 111*a* includes lips 210 and 211, which extend from an internal surface of aperture 111*a*. Aperture 111*b* includes lips 212 and 213, which extend from an internal surface of aperture 111*b*. Aperture 151*a* includes lips 214 and 215, which extend from an internal surface of aperture 151*a*. Aperture 151*b* includes lips 216 and 217, which extend from an internal surface of aperture 151*b*. Apertures 111*a* and 111*b* are in fluid communication with channel 120 of first section 110 of duct 200. Apertures 151*a* and 151*b* are in fluid communication with channel 160 of second section 150 of duct 200. The respective pair of lips corresponding to apertures 111*a*, 111*b*, 151*a* and 151*b*, allow for a plate, brick, block to be placed thereon. As shown in FIG. 6C, plate 400 is within aperture 111*b* and resting on lips 212 and 213. By introducing plate 400, fluid communication between aperture 111*b* and channel 120 is blocked. The arrangement of the aforementioned lips (210-217), in their respective pairs, allows for customization of the gas, heat, fluid flow between sections 110 and 15 of duct 200 from the respective heating walls (illustrated in FIG. 2). As described supra, an inspection aperture may be arranged within proximal surface 101 of duct 200—thereby allowing access to plate 400.

Thus, cross over duct 200 forms three purposes: as generally illustrated by duct 100 in FIG. 2, it encloses oven 34, it encloses flues 32A-D (flues 32C and 32D are shown in FIG. 1), and it fluidly connects flues of different heating walls to allow the transfer of gas and/or temperature therebetween-substantially identical to directions illustrated by arrows A1 and A2 shown in FIG. 2 with duct 100.

It should be appreciated that the cross over duct of the present invention must be composed of a material composition that can withstand at least 1,800° F. without deformation or deterioration. It should be further appreciated that the cross over duct of the present invention is composed of a material composition that can withstand the aforementioned temperature minimum during daily operation of the coke oven battery for a minimum of 20 years.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Coke oven battery
20 Regenerator
22 Pier or pillar
24 Regenerator region
28 Floor
30A Heating wall
30B Heating wall
30C Heating wall
30D Heating wall
32A Flue
32B Flue
32C Flue
32D Flue
34 Oven
36 Oven ceiling
38 Battery top
40 Corbel
42 Through-bore
46 Hole
48 Hole
100 Cross over duct
101 Proximal end
102 Distal end
103 First end
104 Second end
105 First side
106 Second side
107 Passageway of cross over duct 100
107A Aperture of passageway 107
107B Aperture of passageway 107
110 Section
111 Aperture of section 110
111*a* Aperture of section 110 of duct 200
111*b* Aperture of section 110 of duct 200
112 Aperture of section 110
120 Channel of section 110
130 Protruding section of section 110
150 Section
151 Aperture of section 150
151*a* Aperture of section 150 of duct 200
151*b* Aperture of section 150 of duct 200

152 Aperture of section 150
160 Channel of section 150
170 Recessed section of section 150
200 Cross over duct
202 Bifurcating section of section 110 of duct 200
204 Bifurcating section of section 150 of duct 200
210 Lip of aperture 111*a*
211 Lip of aperture 111*a*
212 Lip of aperture 111*b*
213 Lip of aperture 111*b*
214 Lip of aperture 151*a*
215 Lip of aperture 151*a*
216 Lip of aperture 151*b*
217 Lip of aperture 151*b*
300 Coal
400 Plate
A1 Arrow
A2 Arrow
D1 Direction
D2 Direction
D3 Direction
D4 Direction

What is claimed is:

1. A cross over duct configured to fluidly connect a first heating wall and a second heating wall in a coke oven, the cross over duct comprising:

a first section having a first internal surface and a second internal surface being perpendicularly arranged, the first section having a first external surface and a second external surface being perpendicularly arranged, the first section having a first side and a second side, the first section having a first channel disposed therein, the first channel defined by a first aperture disposed within the first internal surface and a second aperture disposed within the second internal surface, the first section having a protruding section extending from the second internal surface, the protruding section arranged within respective peripheral edges of the first internal surface, the sides, and the first external surface, the second aperture being disposed within the protruding section; and, a second section having a first internal surface and a second internal surface being perpendicularly arranged, the second section having a first external surface and a second external surface being perpendicularly arranged, the second section having a first side and a second side, the second section having a second channel disposed therein, the second channel defined by a first aperture disposed within the first internal surface and a second aperture disposed within the second internal surface, the second section having a recessed section disposed with the second internal surface, the recessed section arranged within respective peripheral edges of the first internal surface, the sides, and the first external surface of the second section, the second aperture of the second channel being disposed within the recessed section, wherein:

the protruding section is arranged to be at least partially seated within the recessed section thereby fluidly connecting the first and second channels to form a passageway between the first aperture of the first section and the first aperture of the second section.

2. The cross over duct recited in claim 1, wherein the passageway is in communication with the first heating wall and the second heating wall.

3. A coke oven battery, comprising:

an oven floor;

the first heating wall including a first flue;

the second heating wall including a second flue, the second heating wall spaced apart from the first heating wall forming the coke oven therebetween; and, the cross over duct recited in claim 1, the passageway of the cross over duct fluidly connecting the first and second flues of the heating wall.

4. The cross over duct recited in claim 1, wherein the second aperture of the first section and the second aperture of the second section are in fluid communication with one another.

5. The cross over duct recited in claim 1, wherein the first aperture of the first section is in fluid communication with the first heating wall and the first aperture of the second section is in fluid communication with the second heating wall.

6. The cross over duct recited in claim 1 further comprising at least one inspection aperture disposed on the external surface of one or more of the first section or the second section, the at least one inspection aperture in fluid communication with the passageway.

7. The cross over duct for a coke oven battery recited in claim 1, wherein:

the first aperture of the first section further comprises a bifurcating section disposed therein, the bifurcating section dividing the first aperture into a first pair of apertures; and, the first aperture of the second section further comprises a bifurcating section disposed therein, the bifurcating section of the second section dividing the first aperture of the second section into a second pair of apertures.

8. The cross over duct for a coke oven battery recited in claim 7 further comprising:

at least one plate disposed within one of the first aperture of the first section or the first aperture of the second section, the plate being adapted to cover one of the apertures of one of the pairs of apertures.

9. The cross over duct for a coke oven battery recited in claim 8, wherein:

each aperture of the first pair of apertures having a pair of lips extending from an internal surface thereof; and, each aperture of the second pair of apertures having a pair of lips extending from an internal surface thereof, wherein the plate is adapted to rest on a respective pair of lips of one of the apertures of one of the pairs of apertures.

10. The cross over duct for a coke oven battery recited in claim 1, wherein the first aperture of the first section is adapted to be in fluid communication with a first heating wall of the coke oven battery and the first aperture of the second section is adapted to be in fluid communication with a second heating wall of the coke oven battery, such that the passageway fluidly connects the first and second heating walls of the coke oven battery.

11. The cross over duct for a coke oven battery recited in claim 10, wherein the cross over duct forms an oven ceiling for a coke oven disposed between the first and second heating walls of the coke oven battery.

12. The cross over duct for a coke oven battery recited in claim 1, wherein:

the channel of the first section comprises a distal section, a medial section, and a proximal section, wherein the distal section and proximal section of the channel of the first section have a substantially linear configuration, and the medial section has a substantially curvilinear configuration; and, the channel of the second section comprises a distal section, a medial section, and a proximal section, wherein the distal section and proximal section of the channel of the second section have a substantially linear configuration, and the medial section has a substantially curvilinear configuration.

* * * * *